US005852253A

United States Patent [19]

Baricos et al.

[11] Patent Number: 5,852,253

[45] Date of Patent: Dec. 22, 1998

[54] PERSONAL FIREARM SYSTEM

[75] Inventors: Jean Baricos, Ramonville Saint Agne; Guy Valembois, Blagnac; Michel Castarede, Saint-Orens, all of France

[73] Assignee: Etienne Lacroix Tous Artificess.A., France

[21] Appl. No.: 765,168

[22] PCT Filed: Jun. 13, 1995

[86] PCT No.: PCT/FR95/00773

§ 371 Date: Jun. 5, 1997

§ 102(e) Date: Jun. 5, 1997

[87] PCT Pub. No.: WO95/34796

PCT Pub. Date: Dec. 21, 1995

[30] Foreign Application Priority Data

Jun. 14, 1994 [FR] France ..... 94/07230

[51] Int. Cl.[6] ..... F41A 19/68

[52] U.S. Cl. ..... 89/1.41; 89/44.01; 89/126; 89/162; 42/1.11; 42/105; 102/439

[58] Field of Search ..... 89/1.41, 176, 127, 89/162, 44.01, 13.1; 42/1.11, 105; 102/432, 439

[56] References Cited

U.S. PATENT DOCUMENTS

| | | | |
|---|---|---|---|
| 1,599,008 | 9/1926 | Diener . | |
| 1,726,228 | 8/1929 | Juhasz . | |
| 2,093,058 | 9/1937 | Savani | 42/105 |
| 2,167,495 | 7/1939 | Wimmersperg | 89/126 |
| 2,436,175 | 2/1948 | Neal | 89/126 |
| 2,539,275 | 1/1951 | Sahlin et al. | 89/44.01 |
| 2,977,703 | 4/1961 | Sarvis | 42/94 |
| 3,365,828 | 1/1968 | Badali et al. | 42/105 |
| 3,745,878 | 7/1973 | Jamp et al. | 89/126 |
| 3,854,231 | 12/1974 | Broyles | 42/84 |
| 3,894,473 | 7/1975 | Marest et al. | 89/44.01 |
| 4,164,890 | 8/1979 | Elmore et al. | 89/185 |
| 4,197,666 | 4/1980 | Ng | 42/59 |
| 4,398,365 | 8/1983 | Pokhis | 42/1.11 |
| 4,913,054 | 4/1990 | Petersen | 102/439 |

FOREIGN PATENT DOCUMENTS

| | | | |
|---|---|---|---|
| 58157 | 11/1940 | Denmark | 89/126 |
| 0432 005 | 6/1991 | European Pat. Off. . | |
| 2697 881 | 5/1994 | France . | |
| 555876 | 1/1957 | Italy | 89/126 |
| 8505442 | 12/1985 | WIPO | 89/127 |

*Primary Examiner*—Stephen M. Johnson
*Attorney, Agent, or Firm*—Blakely Sokoloff Taylor & Zafman

[57] ABSTRACT

The present invention relates to a personal firearm system characterized by the fact that it comprises at least two launch barrels (300, 500) and damper means (400) associated with at least a main barrel (300) and adapted to limit the recoil force generated thereby on firing.

21 Claims, 5 Drawing Sheets

232
230
234
120
110
102
100
510
520
210
410
212
214
200
400
250
220
260
500
502
330
306
302
300
304
341
216
IV
357
340
342
310
359
III
350
355
320
358
357
352
356
358
359
354
300
340
342

PERSONAL FIREARM SYSTEM

BACKGROUND OF THE INVENTION

Field of the Invention

The present invention relates to the field of personal firearms.

SUMMARY OF THE INVENTION

Numerous personal firearms have already been proposed.

The main object of the present invention is to improve existing personal firearm systems.

A particular object of the present invention is to provide a novel personal firearm system of improved handiness, which can use projectiles of a wide variety, both respect to range and with respect to mode of action, and which makes it possible to use projectiles of large mass with a portable gun.

In a first aspect, the present invention achieves these objects by a personal firearm characterized by the fact that it comprises at least two launch barrels and damper means associated with at least a main barrel and adapted to limit the recoil force generated thereby on firing.

In a second aspect, the present invention achieves the above-specified objects by a firearm including means adapted to enable the firearm to be supported on the forearm of the user.

Description of the Prior Art

Document U.S. Pat. No. 3,854,231 (BROYLES) describes a twin barrel firearm system. That document proposes limiting the recoil effect by expelling a counter-charge from the back of the gun while simultaneously ejecting a useful charge from the front. That document neither teaches nor suggests associating an anti-recoil damping system with the gun.

Document FR-A-2 697 881 relates to a friction damper. That document does not teach a multi-barrel firearm system.

Documents U.S. Pat. No. 1,599,008 (DIENER) and U.S. Pat. No. 4,197,666 (NG) relate to multi-barrel guns. However those documents do not suggest damper means in any way.

BRIEF DESCRIPTION OF THE DRAWINGS

Other characteristics, objects and advantages of the present invention appear on reading the following detailed description with reference to the accompanying drawings, given by way of non-limiting example, and in which.

DESCRIPTION OF THE PREFERRED EMBODIMENT(S)

Figure 1:
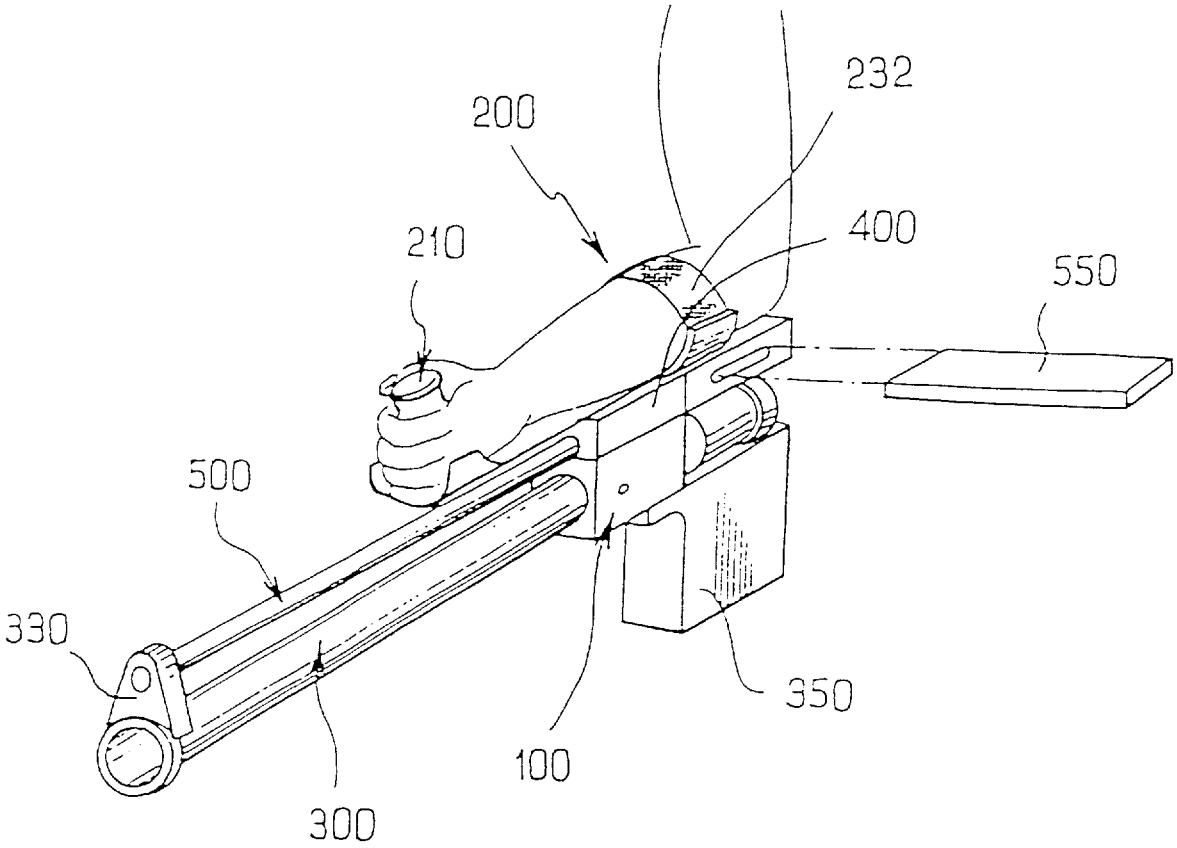
FIG. 1 is a diagrammatic perspective view of a firearm system in accordance with the present invention carried beneath the forearm of a user.

The personal firearm system in accordance with the present invention shown in the accompanying figures essentially comprises:

- a support base 100;
- means 200 linked to the support base and adapted for being carried by the forearm of a user;
- a main tube or barrel 300;
- a damper system 400 associated with the main barrel 300; and
- a secondary tube or barrel 500.

By way of non-limiting example, the main barrel 300 may, for example, have a calibre of 40 mm and the small calibre secondary barrel 500 may have a calibre of 5.56 mm.

The support base 100 may be implemented in numerous variants. It is essentially constituted by a rigid structure. The rigid structure defines two parallel chambers or channels 110 and 120 respectively housing the main barrel 300 and the secondary barrel 500.

The support means 200 are placed essentially on the top surface 102 of the base 100. The support means 200 include a main handle 210 projecting from the top surface 102 of the base 100, e.g. substantially halfway therealong.

The main handle 210 is fitted with a firing button 214 and with a safety switch 216.

The support means 200 advantageously also include a front handle 220 projecting from the top surface 102 and situated substantially on the front end of the base 100. By having two handles 210, 220, it is possible to hold the gun with both hands.

The support means 200 also preferably include a forearm or elbow cradle 230 near the back end of the base 100. The forearm or elbow cradle 230 is in the form of a concave shell against which the forearm presses. It is preferably provided with a safety switch that prevents initialization so long as the user's forearm is not properly positioned on the forearm or elbow cradle 230.

Figures 2, 3, 4:
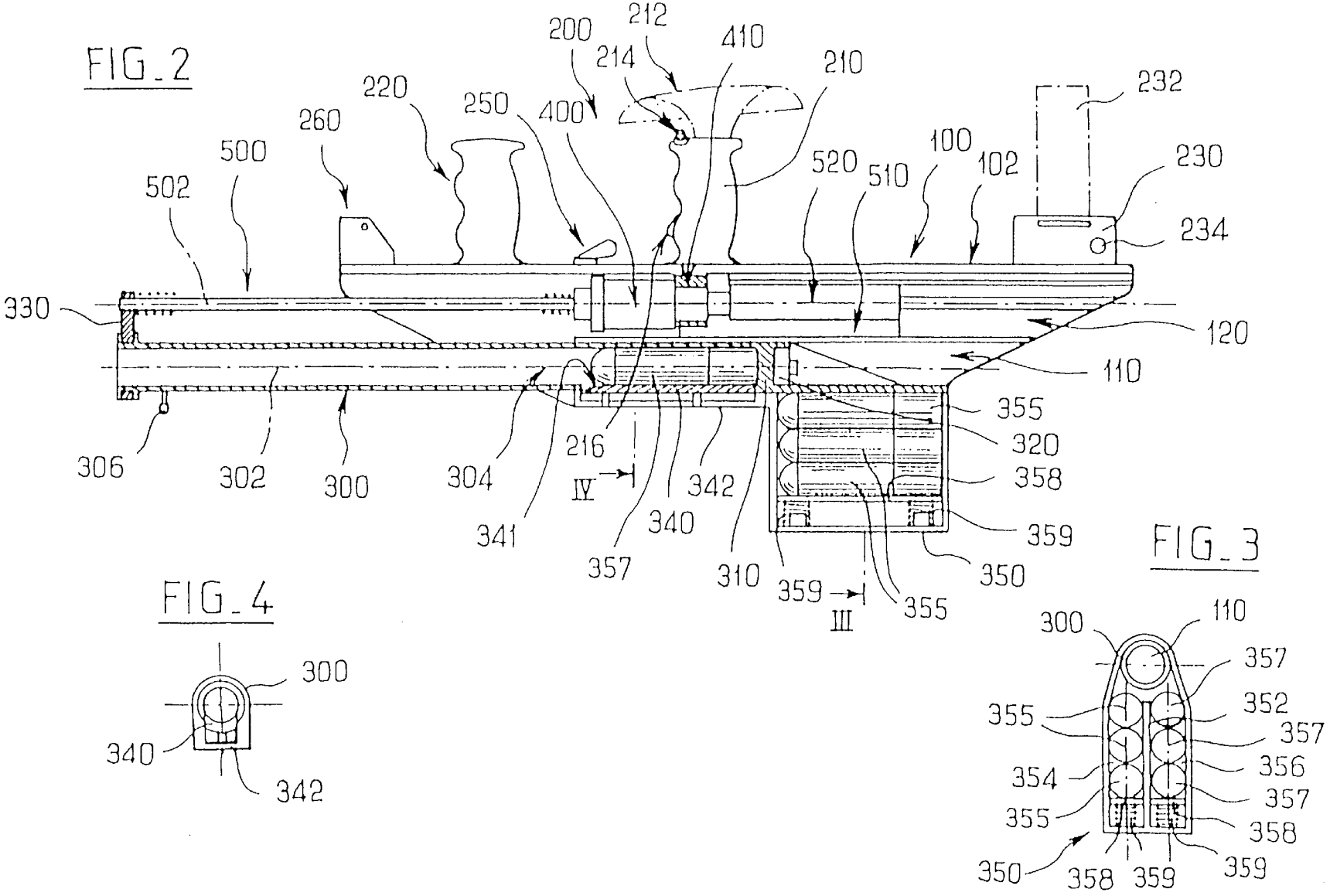
FIG. 2 is a diagrammatic longitudinal axial section view of a firearm system in accordance with the present invention.
FIG. 3 is a cross-section view of the same firearm system in a section plane referenced III in FIG. 2.
FIG. 4 is a second cross-section view of the same firearm system of the invention in a section plane referenced IV in FIG. 2.

The main handle 210, and where appropriate the front handle 220, may be provided with respective cradle plates 212 at their top ends, as sketched by chain-dotted lines in FIG. 2.

The forearm or elbow cradle 230 is preferable also associated with a strap 232 designed to surround the user's forearm, in front of the elbow, as can be seen in FIG. 1.

Because the gun is carried by the forearm, advantageously beneath the forearm as shown in the accompanying figures, a high degree of mobility is provided. Also, the recoil of the forearm itself, after firing, provides a recoil damping effect by a pendulum effect.

A selector 250 is also preferably provided on the top surface 102 of the base 100.

As explained below, the selector 250 is preferably adapted to enable selection to be made between three positions: a) firing prevented; b) a large calibre projectile can be fired via the main barrel 300; or c) a small calibre projectile can be fired via the secondary barrel 500.

Aiming means 260, e.g. of the camera type, are preferably also provided on the top surface 102 of the base 100 and connected to an operating system provided on the helmet of the user by any appropriate means.

For this purpose, the forearm or elbow cradle 230 is advantageously provided with a connector 234 for providing a connection with the above-mentioned operating means provided on the helmet.

The two chambers 110 and 120 are preferably superposed vertically on the base 100 and are not disposed side by side. More precisely, the chamber 110 receiving the main barrel 300 is preferably beneath the chamber 120 receiving the smaller calibre secondary barrel 500.

Nevertheless, in a variant, the two chambers 110 and 120 could be juxtaposed horizontally.

The large calibre main barrel 300 is a tube that is closed at the back by a breech or bottom 310. The main barrel 300 thus operates by a mortar effect.

An electrical firing system 320 is provided on the back of the breech 310. The main barrel 300 is guided to slide in the chamber 110 along its longitudinal axis 302. The front end of the main barrel 300 is preferably connected to the front end of the parallel secondary barrel 500 by a link 330. The secondary barrel 500 is likewise guided to slide parallel to its axis 502 in the secondary chamber 120.

Also, the secondary barrel 500 seres as a damper rod for the large calibre barrel 300.

Figure 8:
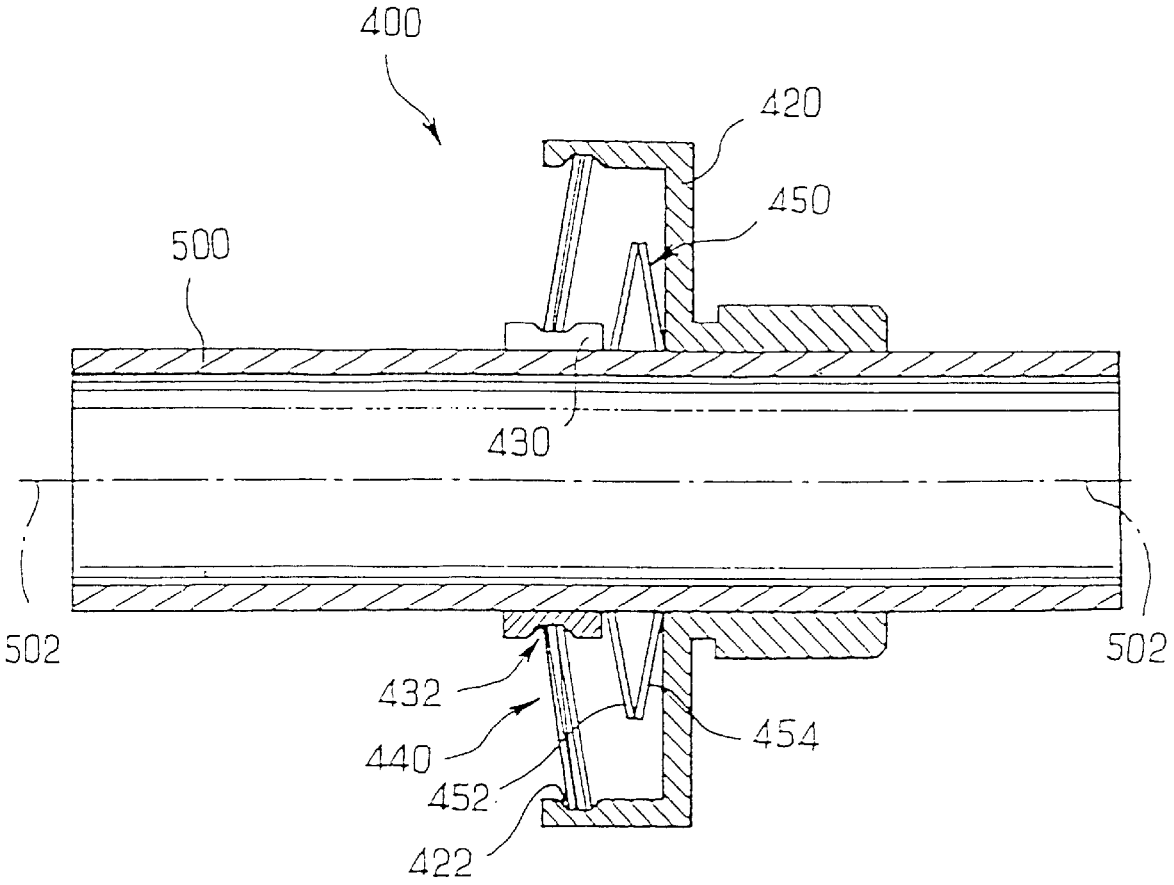
FIG. 8 is a longitudinal axial section view of a damper system in accordance with the present invention.

More precisely, the damper 400 associated with the main barrel 300 and with the rod 500 is preferably of the type shown in FIG. 8, even though that disposition is not limiting.

The chamber 304 inside the main barrel 300 is provided at its back end and in its bottom portion with a closure flap 340. The closure flap is suitable for being moved perpendicularly to the axis 302 in a recess 342 provided in the bottom portion of the base 100 when the main barrel 300 moves back into the chamber 110 such that the opening 341 thus released laterally in the main barrel 300 is caused to face a charger 350 secured to the base 100, thereby enabling a new round to be automatically inserted into said chamber 304.

To this end, the charger 350 is preferably designed to contain several types of ammunition (e.g. 2 types of ammunition). These types of ammunition can be embodied in numerous different ways. The number of rounds made also vary over a wide range.

By way of non-limiting example, the charger 350 may be designed to contain two series of three rounds each: three burst rounds and three dart rounds.

The main barrel 300 is advantageously free to rotate about its axis 302 in indexed manner so that by rotating about the axis 302 under control of a selector lever 306, e.g. provided at the front end of the main barrel 300, the opening 341 provided through the barrel 300 in register with the flap 340 can be placed to receive rounds from one or other of the two series.

In FIG. 3, there can be seen the charger 350 constituted by a housing suspended vertically beneath the base 100. The housing 350 possesses a vertical central partition 352 defining two compartments 354 and 356 each housing three rounds 355 or 357.

These various rounds 355 and 357 are urged towards the opening 341 in the main barrel 300 provided with the flap 340 by a respective pusher 358 associated with a spring 359.

The magazine 350 can be fixed beneath the base 100 in removable manner by any appropriate means.

The large calibre main barrel 300 is preferably also provided with a silencer and a muzzle brake.

The small calibre secondary barrel 500 is guided to slide along its axis 502 in the secondary chamber 120. The secondary barrel 500 is likewise a tube closed at its back end and it too consequently operates by the mortar effect.

More precisely, the secondary chamber 120 supports in stationary manner a damper support 410. The damper 400 is connected to said support 410 and receives the secondary barrel 500 slidably on the axis 502. The damper 400 is thus held in position in the chamber 120 of the base 100.

In an advantageously embodiment, the damper system 400 is of the type described and shown in an earlier PCT patent application filed in the name of the Applicant claiming priority from French patent application No. 92/13428 and published under the No. 2 697 881. Said PCT patent application and French patent application should be considered as being included in the present description by the reference made thereto.

There follows a description of a preferred embodiment of such a damper system 400, with reference to accompanying FIG. 8.

This accompanying FIG. 8 is identical to FIG. 15 of the above-specified PCT patent application.

FIG. 8 shows the secondary barrel 500. This barrel is placed in a damper box 420 rigidly connected to the base 100. The secondary barrel 500 is guided to move in translation on its axis 502 through the box 420.

The damper system 400 includes a shoe 430 which rests against the barrel 500. The shoe 430 is preferably in the form of a split friction ring or bush engaged on the barrel 500. The damper system 400 also includes control means 440 interposed between the shoe 430 and the box 420, which control means 440 are adapted to exert a force on the shoe 430, tending to press said shoe against the secondary barrel 500 during recoil of the barrels 300 and 500, and to reduce the force exerted on the shoe 430 while the barrels are returning.

These control means 440 are preferably constituted by resilient means that operate in buckling.

Figure 9:
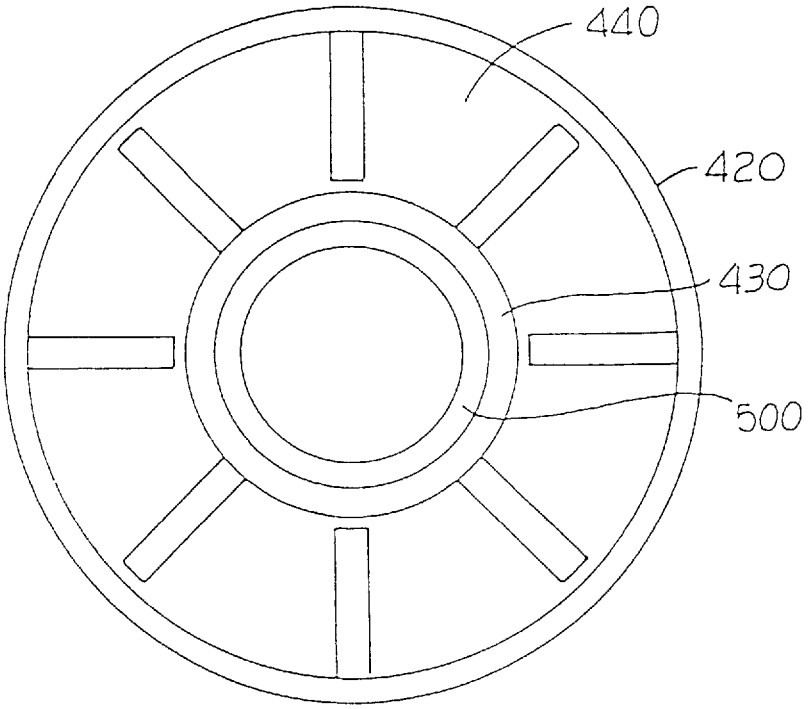
FIG. 9 is a front view of FIG. 8.

More precisely and preferably, the control means 440 comprise a stack of a plurality of resilient washers, each comprising a star-shaped washer constituted by a cone having radial cutouts opening out alternately to its inside periphery and to its outside periphery, as shown in FIG. 9.

The washers 440 thus constitute a multitude of beams suitable for working in buckling.

The outer periphery of the washers 440 is received in a groove 422 formed in the box 420. The inner periphery of the washers 440 is received in a groove 432 formed in the shoe 430 so that the washers 440 urge the bush 430 against the rod 500.

It should be observed that in FIG. 8 there is also provided resilient abutment 450 between the friction bush 430 and the box 420.

This resilient abutment 450 can be implemented in numerous ways. It is advantageously constituted by two Bellevile type spring washers 452 and 454 mounted opposite ways round with their concave sides facing each other and pressing against each other via their outer peripheries.

It should be observed that at rest there is a small amount of axial clearance between the resilient abutment 450 and the friction bush 430 or the box 420.

The axial abutment 450 is preferably adapted to generate a linear closing force as a function of its axial deformation or strain.

The damper device shown in FIG. 8 operates as follows.

When the system is at rest, the washers 440 are frustoconical. Consequently, the corresponding buckling beams are rectilinear in a "standby" position. The resilient abutment 450 is not loaded.

The friction bush 430 is pressed against the barrel 500 by the resilience of the washers 440.

During recoil of the barrels 300 and 500, the jamming effect of the mechanism causes the friction bush 430 to be entrained with the barrel 500. The washers 440 are then subjected to buckling stress.

The axial clearance and the allowable deformation of the axial abutment 450 are adapted to enable the washers 440 to deform towards their second stable equilibrium state, i.e. for the concave side of the washers to be swapped over (in the displacement direction of the barrel 500 at rest and in the opposite direction after loading).

The displacement of the bush 430 relative to the box 420 comes to an end when the beams 440 have been subjected to buckling deformation and return to a rectilinear position and find themselves loaded by the resilient abutment 450.

The damper system is adapted so that the curve of closing force from the resilient abutment 450 intersects the curve of friction force on the shoe 430 against the barrel 500 in the falling front of the curve.

During relative displacement in the active stress direction, the friction force due to the shoe 430 opposes the action of the resilient abutment 450.

In the event of too much friction force, the collapse of the resilient abutment 450 allows the washers 440 to release.

Slip thus takes place under a friction force that is properly controlled by the resilient abutment 450.

When the mechanism is no longer stressed, the shapes of the washers 440 and of the resilient abutment 450, and also the clearance, cause the washers 440 to return to their first stable equilibrium state as shown in FIG. 8.

To sum up, at the beginning of recoil, the deformation to pass from the standby state to the controlled friction state takes place by passing through forced buckling going from an initial equilibrium position of the washers 440 tending to stiffen the system, towards a second equilibrium position of the washers 440 tending to release them, with such release being controlled by the resilient abutment 450.

It can be shown that the tangential effect of friction during relative sliding between the barrel 500 and the bush 430 can be written:

$$T=F_0 f\,(f+\tan\alpha)$$

where:

f=the coefficient of friction between the bush 43 and the barrel 500;

$\alpha$=the angle inclination of the buckling blades 440 relative to the normal to the axis 502, in the controlled friction position; and $F_0$=the opposing axial force produced by the resilient abutment 450.

In addition, the secondary barrel 500 is guided to slide in the chamber 120 via a support or slide 510.

The breech 520 of the secondary barrel 500 is placed in the slide 510, i.e. behind the support 410. The breech 520 is preferably associated with electrical firing means for the secondary barrel 500.

As can be seen in FIG. 1, the secondary barrel is preferably side-loading. In FIG. 1, a magazine for the secondary barrel 500 is referenced 550.

The firearm system in accordance with the present invention operates essentially as follows.

The base 100 is secured to the damper support 410 and the damper 400.

When the firing means 320 are initiated by acting on the button 214 (and after selecting the main barrel 300), a round contained in the main barrel 300 is fired. The barrels 300 and 500 together with their respective supports and breeches 310 and 520 recoil simultaneously. More precisely, the recoil of the main barrel 300 is damped by the damper system 400.

The flap 340 is retracted into the recess 342 provided in the bottom portion of the base 100.

The chamber 304 of the main barrel 300 is then open at the window 341 facing the central partition 352 of the charger 350 in the maximum recoil position.

The main barrel 300 can be automatically reloaded in this recoil position by rotating about its axis 302 so as to place the opening 341 to face a round of the selected type contained in the magazine 350.

The main barrel 300 is then returned forwards to its firing position, either manually or automatically. Naturally, the main barrel 300 can initially be moved forwards while empty, and can be loaded subsequently by being moved backwards and rotated so as to retract the flap 340.

When the main barrel 300 has returned to the front position, the flap 340 closes under drive from a return spring. Consequently it centers the round therein.

The gun is then ready to fire again.

When the secondary barrel 500 is selected, the gun fires projectiles contained in the magazine 550 in conventional manner.

When the secondary barrel 500 fires a round, it may recoil slightly and be damped by the damper 400. The secondary barrel 500 can be returned to its firing position manually or automatically, e.g. by means of a spring 504 placed between the damper body 400 and the link 330, around the secondary barrel 500.

Figure 5:
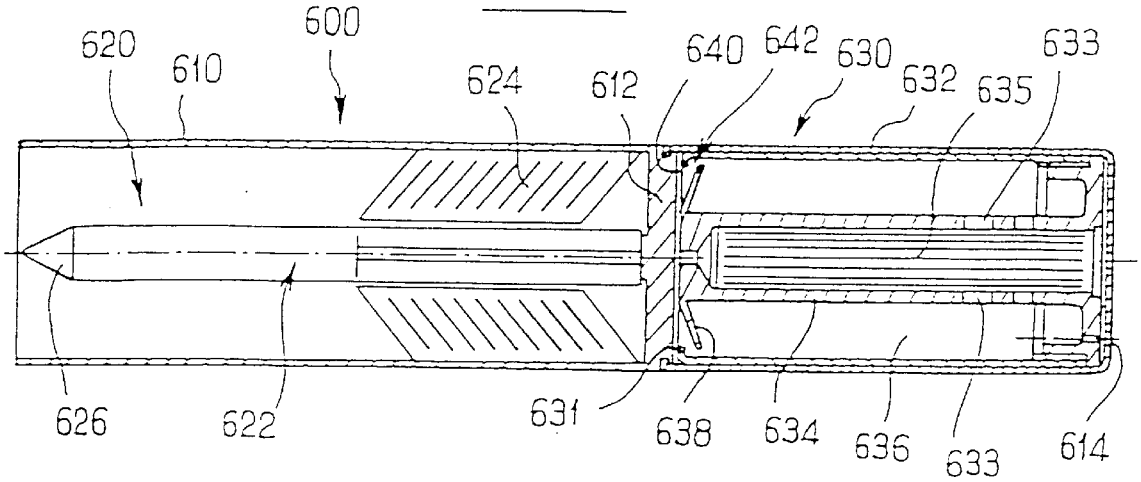
FIGS. 5, 6, and 7 are longitudinal axial section views of three different rounds in accordance with the present invention.
Figure 6:
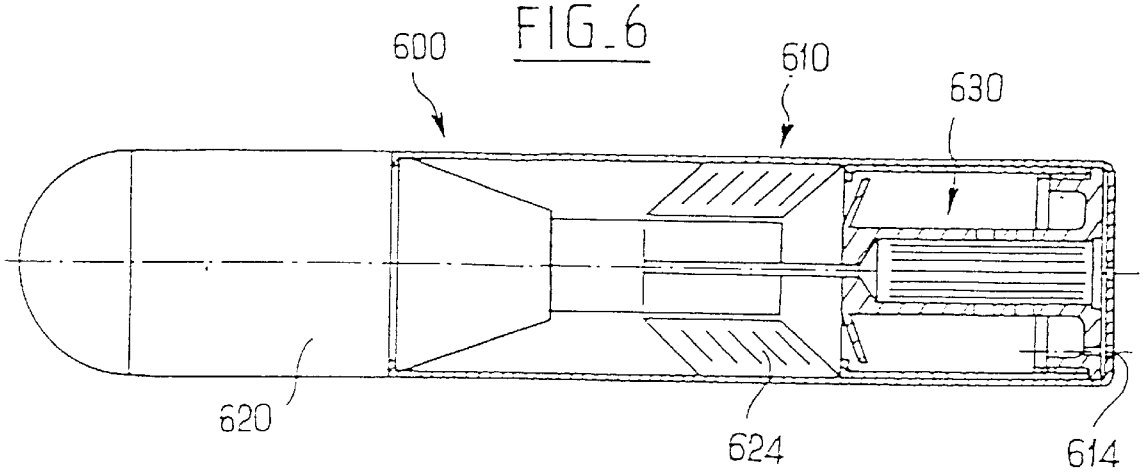
Figure 7:
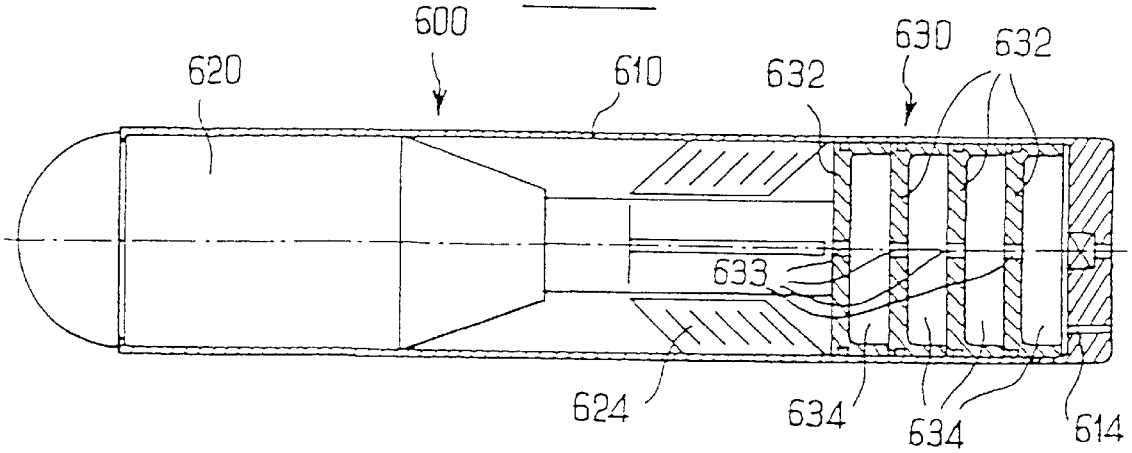

The ammunition shown in FIGS. 5 to 7 is described below.

This ammunition is designed for the large calibre main barrel 300. The ammunition fired by the secondary barrel 500 is preferably conventional kinetic effect ammunition.

The round 600 shown in FIG. 5 comprises a main cartridge 610 housing a projectile 620 provided at its back end with an auxiliary cartridge 630 constituting a thruster.

In this case, the projectile 620 is in the form of a dart having a cylindrical central rod 622 provided at its back end with a tail 624. The front tip 626 of the dart is advantageously pointed.

Such a projectile 620 is designed to pierce armor. The rod 622 is advantageously based on tungsten.

The thruster assembly 630 can be implemented in numerous different ways. It is therefore not described in detail below.

It should nevertheless be observed that this thruster assembly 630 is preferably of the kind described in French patent application No. 93 14301 filed on Nov. 30, 1993.

Briefly, this thruster assembly 630 comprises a sleeve 632 housing a central body 634 receiving a pyrotechnic cartridge 635 that generates gas under pressure. The body 634 is connected to the sleeve 632 at its rear end. Between the central body 634 and the sleeve 632, an intermediate annular chamber 636 is defined.

The pyrotechnic cartridge 635 communicates with the intermediate chamber 636 via radial through passages 633 formed in the central body 634.

The front end of the intermediate chamber 636 opens out into an expansion chamber 640 formed between the base 612 of the main cartridge 610 and the thruster assembly 630. More precisely, the intermediate chamber 636 is partially closed in its zone for communicating with the expansion chamber 640 by means of a resilient wall 638 in the form of a genuinely frustoconical ring integrally formed or added to the front end of the central body 634.

Between the outer periphery of the resilient wall 638 and an annular shoulder 631 formed at the front end of the sleeve 632, there is defined a controlled passage 642 in the form of an annular slot. The resilient wall 638 thus enables the pressure in the expansion chamber 640 to be regulated and consequently enables the recoil force applied to the base 100 to be limited. This servo-system operates essentially as follows. Deformation of the resilient wall 638 enables the section of the passage 642 to be opened and closed progressively so as to maintain substantially constant pressure in the expansion chamber 640.

High pressure in the intermediate chamber 638 closes the section of the passage 642, while lower pressure in the intermediate chamber 636 allows the passage 642 to open.

Naturally, the gas generator or "thruster" 630 is not limited to the embodiment shown in FIG. 5. In particular, the resilient wall 638 could be replaced by any equivalent servo-control valve, e.g. in the form of a distributor valve as described and shown in above-mentioned French patent application No. 93/14301.

Also, as described in said patent application FR-93/14301, the servo-control valve means regulating the pressure in the expansion chamber 640 can be formed on the barrel 300 itself, or on an element that is independent of the barrel 300 and of the ammunition, and that is placed at the breech end of the barrel 300.

Such a gas generator 630 serves to reduce the maximum or peak amplitude of the pressure generated and consequently to reduce the thickness of the wall of the tube, and thus the mass thereof, and to reduce the recoil force.

The round 600 shown in FIG. 6 comprises a main cartridge 610 whose front portion houses a projectile 620 and whose rear portion houses a thruster assembly 630.

The projectile 620 is a burst shell fitted with fins 624 at its back end.

The thruster assembly 630 shown in FIG. 6 is substantially identical to that of above-described FIG. 5.

The round 600 shown in FIG. 7 differs from that shown in FIG. 6 by the fact that the thruster assembly 630 is built up of a plurality of stages that are juxtaposed axially. More precisely, a plurality of axially juxtaposed pistons 632 are thus provided, each being associated with a respective propellant charge 634. Fire is transmitted automatically between the various charges 634 by respective central channels 633 provided through each piston 632.

As can be seen in FIGS. 5 to 7, the cartridges 610 of the rounds 600 are advantageously provided with a controlled rear leak 614 through their respective bases to enable the cartridges to be ejected automatically to the front or muzzle of the barrel 300.

Means are preferably provided for holding the rounds 600 at the back end of each barrel 300 or 500 before firing. These means may be constituted, for example, by magnets provided in the breeches 310 and 520.

As mentioned above, the firearm system of the present invention is preferably provided with an aiming system provided on the user's helmet, which is preferably of the head-up display type. Such a system is designed to show the target on a visor that is available to the user. The trajectory of the projectile can be controlled by the user or by a computer provided on the helmet or on the gun.

Such a head-up display system is important since the gun is held beneath the forearm so the line of sight is no longer directly in alignment with the eye.

The connection between the aiming means 260 provided on the firearm system and the head-up display system provided on the helmet can be provided by any appropriate means, e.g. by optical fiber.

The main barrel 300 enables long-range ammunition to be fired, e.g. having a range of about 600 meters (m), while the secondary barrel 500 serves to deliver conventional kinetic energy projectiles, and thus to deliver conventional small mass rounds in large quantities, e.g. rounds having a mass of about 5 g.

The present invention provides a very handy gun, and consequently makes it possible to fire in any direction.

In addition, the damper system 400 makes it possible to use a closed, mortar-effect barrel, i.e. no hot gases are ejected backwards so there is no danger of burning the user, and it can be used with projectiles of considerable mass, e.g. 200 g to 300 g.

Naturally, the present invention is not limited to the particular embodiment described above, but extends to any variant coming within the spirit thereof.

In another variant, both barrels 300 and 500 may be of the same calibre.

In another variant, the gun of the present invention may be carried in a manner other than beneath the forearm, for example it may constitute a handgun or it may be carried on the forearm, or it may be carried on one side of the forearm.

In another variant, it is not essential for both barrels 300 and 500 to be exactly parallel, depending on the desired ballistic properties.

What is claimed is:

1. A personal firearm system for launching a projectile within a main cartridge of a round of ammunition, said firearm system comprising:

a support base;

at least two launch barrels in form of a main barrel and a secondary barrel mounted on said support base, at least said main barrel being guided to slide on said support base along a longitudinal axis, said at least two launch barrels being adapted to fire respective projectiles and being subject to a recoil force when a projectile is fired;

means for damping associated with at least said main barrel to limit said recoil force generated thereby on firing, said means for damping being provided between said support base and said main barrel and comprising means for absorbing kinetic energy of said main barrel upon said main barrel sliding on said support base upon firing a projectile; and means for supporting said firearm system in relation to a forearm of a user, wherein said means for supporting said firearm system is adapted to support said firearm system beneath said forearm of said user.

2. A personal firearm system for launching a projectile within a main cartridge of a round of ammunition, said firearm system comprising:

a support base;

at least two launch barrels in form of a main barrel and a secondary barrel mounted on said support base, at least said main barrel being guided to slide on said support base along a longitudinal axis, said at least two launch barrels being adapted to fire respective projectiles and being subject to a recoil force when a projectile is fired, wherein each of said at least two launch barrels having different a caliber, said caliber of said secondary barrel being smaller than said caliber of said main barrel, said secondary barrel constituting a damper rod on which controlled friction is exerted; and means for damping associated with at least said main barrel to limit said recoil force generated thereby on firing, said means for damping being provided between said support base and said main barrel and comprising means for absorbing kinetic energy of said main barrel upon said main barrel sliding on said support base upon firing a projectile.

3. A personal firearm system for launching a projectile within a main cartridge of a round of ammunition, said firearm system comprising:

a support base;

at least two launch barrels in form of a main barrel and a secondary barrel mounted on said support base, at least said main barrel being guided to slide on said support base along a longitudinal axis, said at least two launch barrels being adapted to fire respective projectiles and being subject to a recoil force when a projectile is fired; and means for damping associated with at least said main barrel to limit said recoil force generated thereby on firing, said means for damping being provided between said support base and said main barrel, said means for damping comprising means for absorbing kinetic energy of said main barrel upon said main barrel sliding on said support base upon firing a projectile, and said means for damping further comprising a shoe, said shoe urged against said secondary barrel by resilient means wherein said resilient means include at least one star washer having an inside periphery and an outside periphery, said at least one star washer formed in the shape of a cone and having a plurality of radial cutouts opening out alternately to its inside periphery and to its outside periphery.

4. A personal firearm system for launching a projectile within a main cartridge of a round of ammunition, said firearm system comprising:

a support base:

at least two launch barrels in form of a main barrel and a secondary barrel mounted on said support base, at least said main barrel being guided to slide on said support base along a longitudinal axis, said at least two launch barrels being adapted to fire respective projectiles and being subject to a recoil force when a projectile is fired; and means for damping associated with at least said main barrel to limit said recoil force generated thereby on firing, said means for damping being provided between said support base and said main barrel, said means for damping comprising means for absorbing kinetic energy of said main barrel upon said main barrel sliding on said support base upon firing a projectile, and said means for damping further comprising a shoe, said shoe urged against said secondary barrel by resilient means and wherein said means for damping further comprising a resilient abutment and a damper box, said resilient abutment limiting and controlling displacement of said shoe relative to said damper box.

5. A system according to claim 4, said resilient abutment comprising at least one Bellevile type spring washer adapted to stabilize the force response of said means for damping.

6. A personal firearm system for launching a projectile within a main cartridge of a round of ammunition, said firearm system comprising:

a support base;

at least two launch barrels in form of a main barrel and a secondary barrel mounted on said support base, at least said main barrel being guided to slide on said support base along a longitudinal axis, said at least two launch barrels being adapted to fire respective projectiles and being subject to a recoil force when a projectile is fired;

means for damping associated with at least said main barrel to limit said recoil force generated thereby on firing, said means for damping being provided between said support base and said main barrel and comprising means for absorbing kinetic energy of said main barrel upon said main barrel sliding on said support base upon firing a projectile; and a magazine containing a plurality of ammunition types and a means for selecting said ammunition types, said magazine loaded into said main barrel.

7. A system according to claim 6, said main barrel having a longitudinal axis and said means for selecting comprising a means for guiding said main barrel in rotation about said longitudinal axis of said main barrel and a lever adjacent to said main barrel for rotating said main barrel.

8. A personal firearm system for launching a projectile within a main cartridge of a round of ammunition, said firearm system comprising:

a support base;

at least two launch barrels in form of a main barrel and a secondary barrel mounted on said support base, at least said main barrel being guided to slide on said support base along a longitudinal axis, said at least two launch barrels being adapted to fire respective projectiles and being subject to a recoil force when a projectile is fired, said main barrel further comprising a rear end and a flap adjacent to said rear end, said flap adapted to open automatically to a loading position during recoil of said main barrel; and means for damping associated with at least said main barrel to limit said recoil force generated thereby on firing, said means for damping being provided between said support base and said main barrel and comprising means for absorbing kinetic energy of said main barrel upon said main barrel sliding on said support base upon firing a projectile.

9. A personal firearm system for launching a projectile within a main cartridge of a round of ammunition, said firearm system comprising:

a support base;

at least two launch barrels in form of a main barrel and a secondary barrel mounted on said support base, said support base comprising a top surface, at least said main barrel being guided to slide on said support base along a longitudinal axis, said at least two launch barrels being adapted to fire respective projectiles and being subject to a recoil force when a projectile is fired;

means for damping associated with at least said main barrel to limit said recoil force generated thereby on firing, said means for damping being provided between said support base and said main barrel and comprising means for absorbing kinetic energy of said main barrel upon said main barrel sliding on said support base upon firing a projectile; and means for supporting said firearm system in relation to a forearm of a user, said means for supporting comprising a main handle and a cradle adaptable to either a forearm or an elbow, said main handle and said cradle located on said top surface of said support base to enable said firearm system to be supported beneath said forearm of said user.

10. A system according to claim 9, said means for supporting further comprising an auxiliary handle adjacent to said top surface.

11. A system according to claim 9, said means for supporting further comprising at least one strap adjacent to said top surface.

12. A personal firearm system for launching a projectile within a main cartridge of a round of ammunition, said firearm system comprising:

a support base;

at least two launch barrels in form of a main barrel and a secondary barrel mounted on said support base, at least said main barrel being guided to slide on said support base along a longitudinal axis, said at least two launch barrels being adapted to fire respective projectiles and being subject to a recoil force when a projectile is fired, said main barrel comprising a front end; and means for damping associated with at least said main barrel to limit said recoil force generated thereby on firing, said means for damping being provided between said support base and said main barrel and comprising means for absorbing kinetic energy of said main barrel upon said main barrel sliding on said support base upon firing a projectile; and means for automatically ejecting said main cartridge, of each round of ammunition towards said front end of said main barrel.

13. A system according to claim 12, said main cartridge comprising a base and said means for automatically ejecting comprising a leak in said base of said main cartridge.

14. A personal firearm system for launching a projectile within a main cartridge of a round of ammunition, said firearm system comprising:

a support base;

at least two launch barrels in form of a main barrel and a secondary barrel mounted on said support base, at least said main barrel being guided to slide on said support base along a longitudinal axis, said at least two launch barrels being adapted to fire respective projectiles and being subject to a recoil force when a projectile is fired; and means for damping associated with at least said main barrel to limit said recoil force generated thereby on firing, said means for damping being provided between said support base and said main barrel and comprising means for absorbing kinetic energy of said main barrel upon said main barrel sliding on said support base upon firing a projectile, wherein said projectile is of a mass of about 200 grams to 300 grams.

15. A personal firearm system for launching a projectile within a main cartridge of a round of ammunition, said firearm system comprising:

a support base;

at least two launch barrels in form of a main barrel and a secondary barrel mounted on said support base, at least said main barrel being guided to slide on said support base along a longitudinal axis, said at least two launch barrels being adapted to fire respective projectiles and being subject to a recoil force when a projectile is fired; and means for damping associated with at least said main barrel to limit said recoil force generated thereby on firing, said means for damping being provided between said support base and said main barrel and comprising means for absorbing kinetic energy of said main barrel upon said main barrel sliding on said support base upon firing a projectile, said main cartridge comprising a base and said round of ammunition further comprising an auxiliary cartridge thruster assembly, said thruster assembly comprising a sleeve housing a central body having radial through-passages and receiving a pressure source, a servo-control valve adjacent to said central body, an intermediate annular chamber formed between said central body and said sleeve, said pressure source communicating with said base of said main cartridge through said intermediate annular chamber communicating with an expansion chamber formed between said thruster assembly and said base of said main cartridge through a passage formed between said sleeve and said servo-control valve, where said passage is controlled by said servo-control valve.

16. A system according to claim 15, wherein said sleeve comprising a shoulder and said servo-control valve is formed by a resilient wall movable relative to said shoulder.

17. A personal firearm system for launching a projectile within a main cartridge of a round of ammunition, said firearm system comprising:

a support base;

at least two launch barrels in form of a main barrel and a secondary barrel mounted on said support base, at least said main barrel being guided to slide on said support base along a longitudinal axis, said at least two launch barrels being adapted to fire respective projectiles and being subject to a recoil force when a projectile is fired; and means for damping associated with at least said main barrel to limit said recoil force generated thereby on firing, said means for damping being provided between said support base and said main barrel and comprising means for absorbing kinetic energy of said main barrel upon said main barrel sliding on said support base upon firing a projectile, said ammunition comprising a main cartridge housing a projectile, said projectile being in the form of a dart having a back end fitted with an auxiliary cartridge thruster assembly.

18. A system according to claim 17, said thruster assembly comprising a plurality of pistons and a plurality of propellant charges associated with said plurality of pistons so that fire is capable of being transmitted automatically between adjacent pistons and propellant charges.

19. A personal firearm system for launching a projectile within a main cartridge of a round of ammunition, said firearm system comprising:

a support base;

at least two launch barrels in form of a main barrel and a secondary barrel mounted on said support base, at least said main barrel being guided to slide on said support base along a longitudinal axis, said at least two launch barrels being adapted to fire respective projectiles and being subject to a recoil force when a projectile is fired; and means for damping associated with at least said main barrel to limit said recoil force generated thereby on firing, said means for damping being provided between said support base and said main barrel and comprising means for absorbing kinetic energy of said main barrel upon said main barrel sliding on said support base upon firing a projectile, said ammunition comprising a main cartridge having a front portion and a back portion, said front portion housing a burst projectile and said back portion housing an auxiliary cartridge thruster assembly.

20. A system according to claim 19, said thruster assembly comprising a plurality of pistons and a plurality of propellant charges associated with said plurality of pistons so that fire is capable of being transmitted automatically between adjacent pistons and propellant charges.

21. A personal firearm system for launching a projectile within a main cartridge of a round of ammunition, said firearm system comprising:

a support base;

at least two launch barrels in form of a main barrel and a secondary barrel mounted on said support base, at least said main barrel being guided to slide on said support base along a longitudinal axis, said at least two launch barrels being adapted to fire respective projectiles and being subject to a recoil force when a projectile is fired; and means for damping associated with at least said main barrel to limit said recoil force generated thereby on firing, said means for damping being provided between said support base and said main barrel and comprising means for absorbing kinetic energy of said main barrel upon said main barrel sliding on said support base upon firing a projectile, said main cartridge comprising a base and said round of ammunition further comprising an auxiliary cartridge thruster assembly, said thruster assembly comprising a sleeve housing a central body having radial through-passages and receiving a pressure source, a servo-control valve adjacent to said central body, an intermediate annular chamber formed between said central body and said sleeve, said pressure source communicating with said base of said main cartridge through said intermediate annular chamber communicating with an expansion chamber formed between said thruster assembly and said base of said main cartridge through a passage formed between said sleeve and said servo-control valve, where said passage is controlled by said servo-control valve, said main cartridge having a back portion housing said thruster assembly wherein said servo-control valve is placed in said thruster assembly to form a pressure regulator.

* * * * *